United States Patent [19]

Clark

[11] 4,394,242

[45] Jul. 19, 1983

[54] CLAMP, TOOL, AND ELECTROLYSIS CELL ANODE MOUNT

[75] Inventor: John F. Clark, Pittsburgh, Pa.

[73] Assignee: Adnovum AG, Horn, Switzerland

[21] Appl. No.: 198,800

[22] Filed: Oct. 20, 1980

Related U.S. Application Data

[62] Division of Ser. No. 115,621, Jan. 28, 1980, Pat. No. 4,269,673.

[51] Int. Cl.[3] ..... C25C 3/10; C25D 17/04; B25B 13/58; B25B 5/04

[52] U.S. Cl. ..... 204/243 R; 204/286; 204/297 R; 204/279; 81/54; 81/180 R; 269/239

[58] Field of Search ..... 204/243 R–247, 204/286, 279, 297 R, 297 W, 225; 81/3 R, 54, 467, 180 R; 269/239; 29/559

[56] References Cited

U.S. PATENT DOCUMENTS

| | | | |
|---|---|---|---|
| 745,412 | 12/1903 | Blackman | 204/286 |
| 2,271,041 | 1/1942 | Stuckert | 269/239 X |
| 2,727,544 | 12/1955 | MacArthur | 269/239 X |
| 2,734,412 | 2/1956 | Orner | 81/52.4 |
| 2,796,899 | 6/1957 | Biro | 269/239 X |
| 3,627,670 | 12/1971 | Duclaux | 204/297 R |
| 3,752,465 | 8/1973 | Siegmund | 204/297 R X |
| 3,888,757 | 6/1975 | Roukema et al. | 204/225 X |
| 4,025,414 | 5/1977 | Vendramini | 204/297 R |
| 4,037,727 | 7/1977 | Kunkle | 204/297 W X |
| 4,077,865 | 3/1978 | Müller | 204/286 X |
| 4,202,753 | 5/1980 | Bradford et al. | 204/247 |
| 4,294,442 | 10/1981 | Kolnes et al. | 269/239 X |

FOREIGN PATENT DOCUMENTS

| | | | |
|---|---|---|---|
| 2147411 | 3/1973 | Fed. Rep. of Germany | 204/243 R |
| 361603 | 6/1962 | Switzerland | 204/297 |
| 524863 | 10/1976 | U.S.S.R. | 204/243 R |

OTHER PUBLICATIONS

Galipeau, A. et al., "Converting of HS Soderberg Cells to Prebake Cells", *Light Metals,* The Metallurgical Society of AIME, vol. 1, 1976, pp. 130–147.

*Primary Examiner*—Donald R. Valentine
*Attorney, Agent, or Firm*—Edwin E. Greigg

[57] ABSTRACT

The invention involves a cell which may be used for producing molten aluminum by electrolysis of aluminum oxide in a molten bath. The cell includes a cathode and an anode, a bar and a hanger. The bar is connected at an upper end to the hanger and at a lower end to the anode. Flexible means is provided for supplying electrical current through the bar to the anode. A jack means raises and lowers the hanger and thus the anode. Included in the invention, the hanger is mounted at at least two separated points, one higher than the other, in encompassing, sliding relationship, on a single, upright, circular cross-sectioned post passing through the hanger. By this technique, the hanger is constrained to move up and down, without rotation about horizontal axes.

The invention additionally involves a clamp including means for providing a backing against which articles to be clamped can be placed, gate means mounted for pivoting about an axis into and out of confrontation with the backing means, the pivot axis passing through the gate means, and means for forcing the gate means toward the backing means at least when the gate means is in confrontation with the backing means. Included in the invention, at least the portion of the gate means at said axis moves toward the backing means during operation of the forcing means in forcing the gate means toward the backing means.

Also provided is a tool capable of operating such a clamp. The tool includes a means for operating the forcing means and a means for pivoting the gate means.

6 Claims, 8 Drawing Figures

CLAMP, TOOL, AND ELECTROLYSIS CELL ANODE MOUNT

This is a division of application Ser. No. 115,621, filed Jan. 28, 1980, now U.S. Pat. No. 4,269,673.

DESCRIPTION

TECHNICAL FIELD

The present invention relates to a cell suitable for producing aluminum by electrolysis, and more particularly to a mount for anodes therein, including features for anode guidance and clamping and means for operating the clamping.

It is well known to use a carbonaceous anode in an electrolysis cell, commonly referred to as a "pot", for producing molten aluminum by the electrolysis of aluminum oxide in a molten bath. Such cells for producing aluminum are referred to as Hall-Heroult cells; and of the almost 15.5 million short tons of primary (i.e. produced from aluminum oxide as contrasted with recycled aluminum) aluminum produced in the world in 1978, almost all such aluminum was produced in Hall-Heroult cells. The carbonaceous anode is consumed during electrolysis, with the evolution of mainly $CO_2$ gas. In order to maintain a minimum anode-cathode spacing to minimize electrical resistance related energy losses, it is desirable to have means for moving the anode up and down. And, when the anode has been consumed as much as practical, it is desirable to have means for raising its remnant out of the molten bath, to unclamp and replace it, and then lower the new anode down into the bath to resume electrolysis at that location. The anode replacement operation takes place every few weeks on each of the several thousand anodes in a modern potline. When this function is done manually, the workmen must stand on the potroom floor in a hot, dusty environment. Thus, there is need for equipment that can be controlled from a remote location.

BACKGROUND ART

In one anode mount including means for lifting and lowering an anode, an aluminum or copper bar is connected at its lower end to the carbon anode and at its upper end to a hanger. Flexible, electrical current conductor means is connected to the hanger for supplying electrical current for electrolysis down through the bar to the anode. A jack screw, universally jointed to a drive motor, cooperates with a nut in the hanger to lift and lower the hanger and thus the bar and anode. The hanger is guided, toward the goal of keeping the anode in a straight up-and-down path, by T-members, whose legs extend into slots in the hanger.

Concerning the clamping of anodes in anode mounts, one clamp is shown in FIG. 10 at page 147, of *Light Metals,* Metallurgical Society of AIME, Volume I, 1976. Such a clamp utilizes a pivotable gate. When the gate is in its down position, it can be forced against an anode bar by the turning of a tightening screw acting on the end of the gate farthest from the pivot. This forces the anode bar against a bus bar for transfer of electrical current and for securement of the anode in a suspended position in the molten bath.

DISCLOSURE OF INVENTION

It is an object of the present invention to provide an anode mount including a hanger guidance system improved over that represented by the above-described T-member/slot system.

Another object of the present invention is to provide a hanger guidance system having the characteristic that it is ideally suited for the peculiarities of the environment found in electrolysis cells for producing molten aluminum by the electrolysis of aluminum oxide in a molten bath.

Another object of the present invention is to provide, in an anode mount, an improved anode clamping mechanism and improved means for operating such mechanism.

In the case of the above-described T-member/slot guidance system, it is quite difficult for installers to get the T-members mounted parallel to one another on a cell superstructure. With the hanger slots for the legs of the T-members ideally being just big enough to allow a sliding fit, any deviation of the T-members from a mutually parallel relationship leads to binding of the hanger between the T-members at locations on the hanger path in its up-and-down travel. A practical solution to this binding has been to cut the slots bigger; but, of course, this leaves the hanger quite loose in previously non-binding parts of its path, this having an adverse effect on the quality of control in the up-and-down anode movements.

It is not entirely, or perhaps even significantly, a problem of the installer getting the T-members parallel to begin with, because the superstructures over these aluminum producing cells are expansive, framework-webbing assembles which are subjected to heat effects from the typically over 900° C. molten bath below them. Not only that, such superstructures bear in this hot environment the large mechanical loads of anodes (which may weigh more than a 1000 pounds apiece) and conductor busses of large cross section (large, in order to accommodate currents of many thousands of amperes at low resistance losses). In this environment, these T-members, even if well installed to begin with, are almost impossible to retain in a precisely mutually parallel relationship.

Regarding clamping mechanisms, the one described in the Background Art section, as well as most, if not all, of the clamps known to the present inventor, represent difficult problems when it comes to automation. In the above-discussed clamp, it would be necessary to devise an automatic tool which would first operate on the tightening screw and then either translate to, or have separate operational means for, the pivot operation.

The above objects, as well as other objects which will become apparent from what follows, are achieved according to the present invention, (1) in a cell which may be used for producing molten aluminum by electrolysis of aluminum oxide in a molten bath, which cell includes a cathode and an anode, a bar and a hanger, the bar being connected at an upper end to the hanger and at a lower end to the anode, flexible means for supplying electrical current through the bar to the anode, and jack means for raising and lowering the hanger and thus the anode, the improvement including that the hanger is mounted at at least two separated points, one higher than the other, in encompassing, sliding relationship, on a single, upright, circular cross-sectioned post passing through the hanger, whereby the hanger is constrained to move up and down, without rotation about horizontal axes; (2) in a clamp including means for providing a backing against which articles to be clamped can be placed, gate means mounted for pivoting about an axis into and out of confrontation with said backing means, the pivot axis passing through the gate means, and means for forcing the gate means toward the backing means at least when the gate means is in confrontation with the backing means, the improvement including that at least the portion of the gate means at the pivot axis moves toward the backing means during operation of the forcing means in forcing the gate means toward the backing means; and (3) a tool capable of operating such a clamp, including a means for operating the forcing means and a means for pivoting the gate means.

BRIEF DESCRIPTION OF DRAWINGS

The details of the present invention will be described in connection with the accompanying drawing, in which.

BEST MODE FOR CARRYING OUT THE INVENTION

Figure 1:
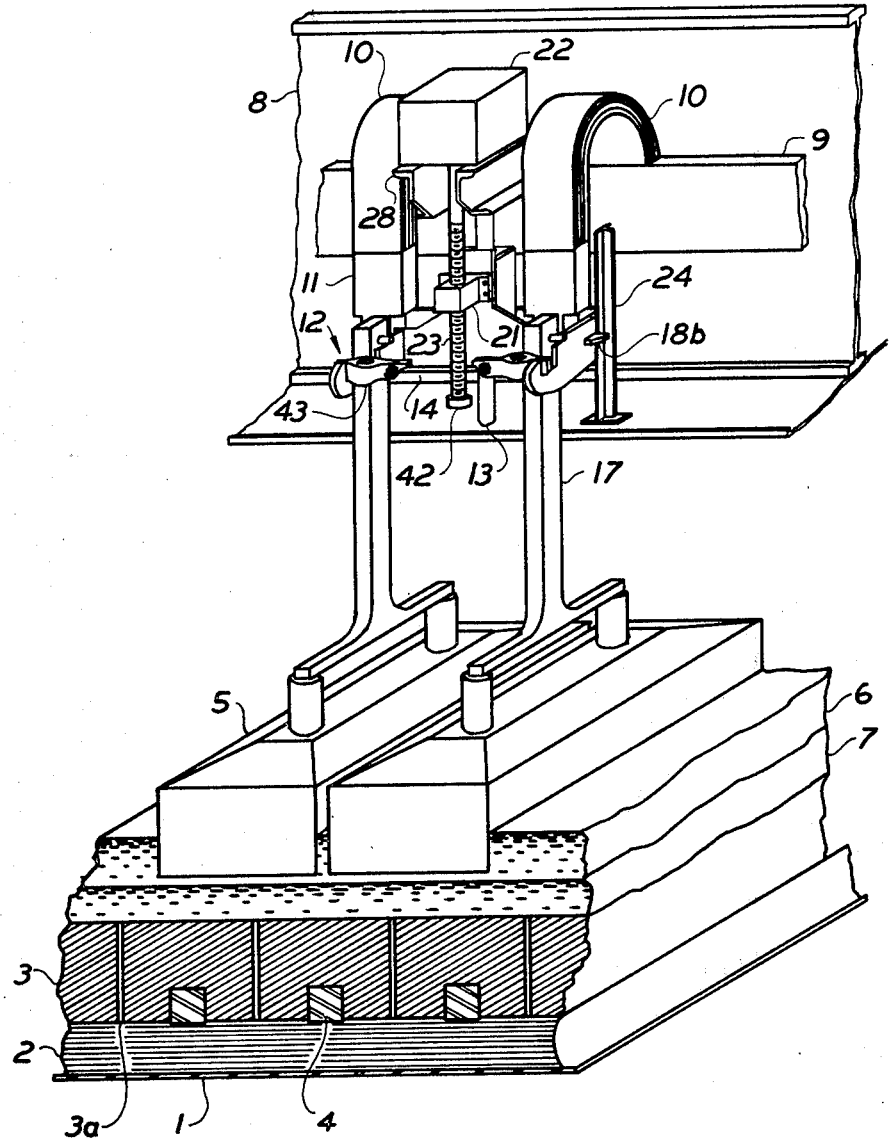
FIG. 1 is an oblique view of an anode mount in a portion of a cell for producing aluminum metal.

Referring to the drawing, FIG. 1 contains an illustrative portion of an aluminum producing cell incorporating an anode mount according to the invention. In one cell, there can, for example, be eight of such mounts, i.e. 16 anodes, extending left and right in FIG. 1, as well as a duplicate set extending left and right in a row behind that of the illustrated mount.

As is well known, the Hall-Heroult electrolytic cells for producing aluminum can typically include a steel shell 1, insulation 2, carbon cathode blocks 3, carbonaceous seams 3*a*, collector bars 4 for connection to an external, negative pole of a direct current (DC) electrical power source, and carbon anodes 5 connected by appropriate means to the positive pole of a DC electrical power source. The electrolytic process for producing aluminum takes place utilizing a cryolite-based, molten bath 6 containing dissolved aluminum oxide. The aluminum metal which is produced becomes incorporated into a molten metal pad 7 situated on the carbon cathode blocks.

Typically these electrolytic cells for producing aluminum will have a superstructure 8 supported on the cell sidewalls or on independent foundations. The superstructure may contain bins for feeding alumina down on top of the molten bath. Additionally, automatic means for breaking in any crust on the frozen bath may be provided mounted on the superstructure.

The superstructure contains mounted thereon a metal bus bar 9 connected to the positive pole of a DC power source. The anodes are desirably connected to the DC bus in a manner which permits anode raising and lowering. In this embodiment, the anode movement makes use of flexible metal straps 10. These straps are composed of many sheets of aluminum, this allowing them to be flexible. The straps are attached to the fixed bus bar 9 at one end and can undergo movement at the other end.

The attachment of the anodes to the movable ends of the flexible straps 10 utilizes a hanger 14 which can be moved up and down by a jack screw 23 turning in a nut-containing nut box 21 fixed to the hanger. It is preferred to suspend two separate anodes 5 from each hanger 14, as shown, in order to facilitate balance and compactness. However, a single anode design can be built by attaching its bar 17 to a hanger dimensioned such that the bar would always be directly below, and spaced from, the jack screw. Electric motor 22, which may be remotely controlled, provides the driving torque for screw 23. A universal joint is provided between motor 22 and screw 23, and the nut in nut box 21 is mounted in a spherical bearing nut so that the nut can follow whatever tilt there may be in the screw 23. The anode bars are fixed against a solid aluminum tab 11 at the free end of the flexible straps using a suitable clamp 12. This clamp is a new and improved one constructed according to the present invention and will be explained in detail below.

According to the present invention, anode raising and lowering is guided by mounting the hanger 14 at two separated points, one higher than the other in encompassing sliding relationship on a single upright circular cross-sectioned post in the form, for example, of tube 13 passing through the hanger. In this way the hanger is constrained to move up and down without rotation about horizontal axes. Preferably, the nut of nut box 21 is placed on the vertical line through the center of gravity of the anode (i.e. in the embodiment of FIG. 1 one-half way between the two anodes), so that tube 13 provides primarily a guidance function, rather than being a load bearing member.

Figure 2:
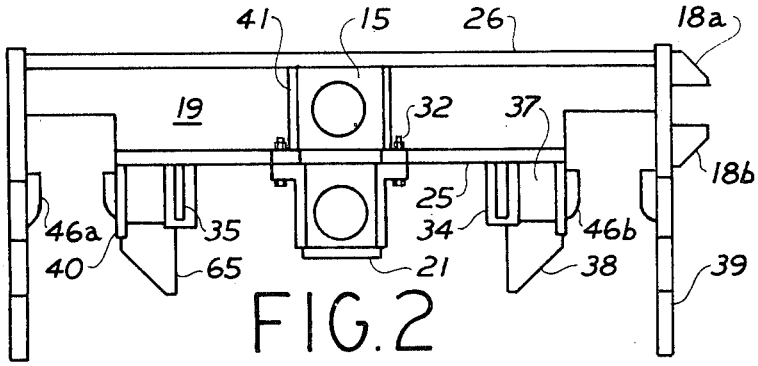
FIGS. 2 to 4 are respectively top, front and rear views of a hanger according to the invention, "top", "front" and "rear" being with respect to a hanger orientation as in FIG. 1.
Figure 3:
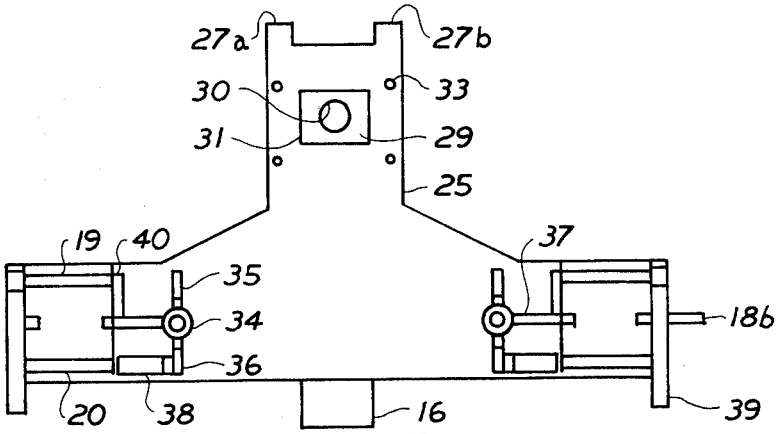
Figure 4:
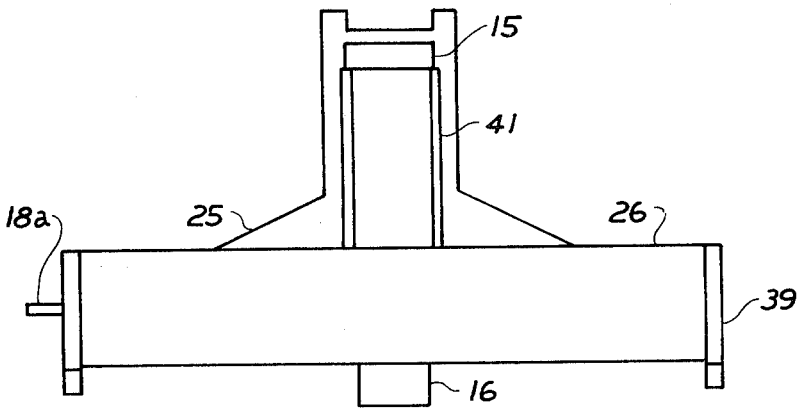

With reference particularly to FIGS. 2 to 4, certain features of a hanger with respect to the anode guidance of the invention are illustrated in greater detail. It will be seen that two separated points whereat the hanger can be mounted in sliding relationship on a tube 13 are provided by block 15 and tube 16, both of which have been bored in line to a close tolerance. For example, with the maximum and minimum outer diameter dimensions of tube 13 being 3.010 and 3.000 inches respectively, the minimum and maximum inner diameter of the bore can be 3.020 and 3.025. Mild steel is a suitable construction material for the tube 13, block 15 and tube 16. Tube 13 is a cold finished, drawn tube and is not machined before use. A suitable distance between the top of block 15 and the bottom of tube 16 can be $20\frac{3}{4}$ inches. An example of the distance from clamp 12 in FIG. 1 to the bottom of the anode is seven feet.

To assemble the hanger with the tube 13, the hanger is slid onto the tube. No lubrication is used because it would catch alumina dust. The tube is then bolted above and below to superstructure 8. With this securement of the hanger, it will be appreciated that the hanger is secured against rotation about horizontal axes, i.e. about axes lying in the plane of FIG. 2. In turn, when the anode bars 17 shown in FIG. 1 are clamped tightly to the hanger, the anodes are themselves tightly held against such rotation. Securement against such rotation is an important aspect of an anode guidance system.

In contrast, rotation about axes perpendicular to the plane of FIG. 2 is comparatively unimportant because such rotations essentially only result in the anode being shifted somewhat over the level surface of the molten metal pad 7. Nevertheless, it is preferred to provide some control of rotations about axes perpendicular to the plane of FIG. 2 and to this end one side of the hanger is provided with two ears 18*a* and 18*b* in which the cross member of a T-iron (item 24 in FIG. 1) can be situated. The T-iron, in turn, is secured below to the superstructure 8.

It has developed that the anode raising and lowering guidance according to the present invention is particularly well suited to its task. Because there is only one post providing constraint against rotation about horizontal axes, the binding previously caused by misalignment of more than one guide is avoided. The optional constraint provided by T-iron 24 can be one in which as great a tolerance as necessary is provided between the T-iron cross member and the ears 18 since, as explained, this constraint is relatively unimportant. Furthermore, any misalignment of the post and the T-iron is accommodated by a rotation of hanger 14 about the circular post, tube 13. Additionally, another particularly attractive advantage of the invention is that it is not necessary to take special steps to achieve or maintain a precisely vertical orientation of the post; this is true because, should the post be somewhat tilted away from vertical, the portion of the lower surface of the anode correspondingly tilted into position nearest metal pad 7 is reacted to $CO_2$ faster, following initial installation of the anode, until the anode lower surface becomes substantially parallel to the metal pad, thereby canceling the effect of the tilt.

Concerning further details of the construction of the hanger embodiment illustrated in FIGS. 2–4, it will be noted that there is a relatively tall front plate 25 which is laterally foreshortened to leave space for tabs 11 (FIG. 1). Then there is a squat, but wide, back plate 26 extending substantially the entire distance across the hanger. Between the front plate and back plate are web plates 19 and 20 to which the front plate and back plate are attached, for example by welding. The upper web plate 19 has a hole through it sufficiently large to permit free passage of tube 13 in the assembly of FIG. 1. The lower web plate 20 has a smaller hole, and tube 16 is welded at that hole. During the in-line boring operation, the boring of the inner diameter of tube 16 is conducted through and including the lower web plate 20.

Front plate 25 is recessed at its top such that ears 27*a* and 27*b* are formed. The purpose of the recess is to guard against interference with a conically spiraled dust cover which may be optionally provided to protect screw 23 against alumina grit. The ears 27*a* and 27*b* provide safety stops for the upward travel of the hanger by contacting a suitable cross-member integral with the superstructure beams 28 (FIG. 1) at the upper limit of the hanger travel. The downward travel stop is provided by contacting of stop nut 42 (FIG. 1) by nut box 21.

Front plate 25 has welded thereon a shear plate 29. The welding is carried out at the base of a hole 30 in the shear plate in order to avoid weld beads on its outer perimeter 31. The purpose of this plate is to take up the shear load which would otherwise arise on bolts 32 when nut box 21 is attached. The nut box is shown attached in FIG. 2 whereas in FIG. 3 it has been omitted in order to show the presence of the shear plate and bolt holes 33 for bolts 32. The nut box fits over the shear plate so that it rests flushly against the front plate 25.

Also mounted on front plate 25 are two internally threaded bosses 34 which are reinforced above and below and on the outer sides by reinforcing gussets 35, 36 and 37, respectively. Additionally provided are two stop plates 38 which serve a function in clamp 12 as will be explained below.

Also to be explained in greater detail below, the hanger contains end plates in the form of hooks 39. Opposite each of the hooks is a tab 40 whose function will be explained below. On the insides of the hooks 39 and the tabs 40 are guide stubs 46*a* and 46*b*.

Block 15 is secured to the front plate, for example by welding, and is supported on pier plates 41 whose footing is provided by upper web plate 19.

It will be understood that the illustrated guidance concept can be redesigned with considerable latitude without departure from the basic concepts. For example, rather than providing separate members in the form of block 15 and tube 16, it is possible to provide just one long tube whose inner diameter can be bored, the two separated points then being provided by the extreme ends of the bore of the pipe, with the intermediate portions of the bore being present but not being significant in terms of resisting rotation about horizontal axes.

Referring now to FIGS. 5–8, a clamp of the invention will be considered in detail. The clamp 12 includes firstly a backing and in this embodiment the backing is provided as a part of hanger 14 in the form of web plates 19 and 20. Further included in the clamp is a gate 43 which has two positions and pivots about the axis of bolt 44 between these positions. In the closed position shown, for example, by the solid line representation in FIG. 7, the gate confronts the backing, while in the open position (broken line representation) indicated by arrow A, the gate is out of confrontation with the backing. Stop plate 38 supports the gate in the open position by the contact of surface 64 against its edge 65 (FIG. 2).

The clamp also includes means by which the portion of the gate at the pivot axis can be forced toward the backing. This means is provided, for example, by the hanger which serves as the backing, by bolt 44 which is secured into the hanger in boss 34, and by a nut 45 which threads onto the outer end of the bolt. The bolt is at the pivot axis, and the gate has a bore which is slid onto the bolt.

Figure 5:
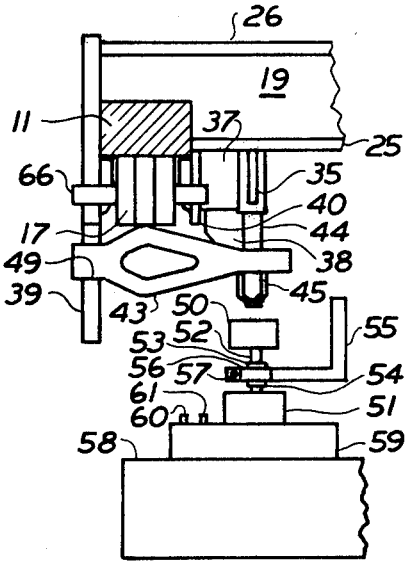

In the closed position of the clamp, as is best shown in FIG. 5, the tab 11 of the flexible lead 10 is situated against the backing. In turn, the anode bar 17 rests against the tab. The anode bar, with anode 5 attached below, is brought into the position shown in FIG. 5 when gate 43 is in the open position of arrow A (FIG. 7). Typically used is a crane whose cable is appropriately secured in a hole 47 shown in FIG. 6. Hole 47 is present in a lifting tab 48 which has been omitted in FIG. 1 for ease of illustration. As the anode bar is brought in by the crane, it may not be exactly lined up and guide stubs 46*a*, 46*b* serve to facilitate its movement into the correct position in the clamp. The gate 43 is then closed and forced against the anode bar by means of nut 45, with the gate fulcruming against the vertical face 49 of hook 39 so that the required bearing force can be brought to bear to create sufficient frictional force to hold the anode bar and tab in the clamp. The fit of gate 43 on bolt 44 is a loose fit to permit the fulcruming against face 49.

Extraction of the tab 11 and anode bar 17 from the clamp would be against friction forces and these can be made quite significant by appropriate tightening of nut 45. A force in bolt 44 can, for example, be 10 tons in order to securely hold the anode bar against slippage. A pin 66 protrudes on either side of the anode bar. This pin can rest on the hook 39 and tab 40 during the anode changing operation, after a new anode bar has been placed in the hanger and before the gate has been tightened. A nib 67 is provided on hook 39 and one correspondingly on tab 40 to guard against pin 66 sliding out of its rest on hook 39 and tab 40. Pin 66 additionally serves to connect lifting tab 48 to anode bar 17.

It is apparent that clamp 12 can be operated by a workman with a wrench. However, according to the present invention, a tool capable of remotely operating, for example, this clamp 12 is provided. The tool appears in part in FIG. 5 with another portion appearing in FIG. 8. The tool includes firstly a mechanism for operating the means which forces the pivot end of the gate toward the backing. In this embodiment, such mechanism comprises a socket 50 which is driven by a pneumatic motor 51 through an intermediary shaft 52. Motor 51 may alternatively be hydraulic or electric.

The tool includes secondly a mechanism for pivoting gate 43. In this embodiment, such mechanism comprises two spaced collars 53 and 54 on shaft 52 and an L-shaped arm 55 frictionally clamped on the shaft between these collars. In this embodiment, the clamping of arm 55 on shaft 52 is accomplished by forming the inner end of the arm as a split ring 56, i.e. two mutually facing semicircular portions, which are tightened into sliding frictional engagement with shaft 52 using screw 57.

Figure 8:
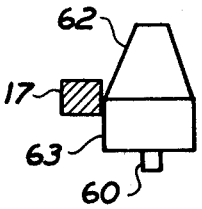
FIG. 8 is a top view of a portion broken out of FIG. 5.

The socket 50 is brought toward the nut by means of an overhead crane or a potroom floor running vehicle or truck 58. Because it is difficult to precisely line up the socket with the nut, there is interposed between the crane or vehicle and the pneumatic motor a spring biased mount 59 which can be moved out of its null position in order to precisely align the socket with the nut. A suitable means for performing this movement out of the null position (which operation is referred to as indexing) is secured on the mount by rods 60, 61 which are broken away in FIG. 5. With reference to FIG. 8, there is shown one of the indexing mechanisms and it will be seen that it is made up of a conically shaped head 62 attached to rod 60. The indexing means in FIG. 8 coacts with the anode bar 17 in order to align the socket with the nut correctly left and right in FIG. 5. As the crane or vehicle approaches the nut, head 62 rides with its conical surface against anode bar 17 and the socket is appropriately positioned left and right. Just as the correct alignment is achieved, the cone merges into a cylindrical surface 63 so that further movement of the crane or vehicle to bring the socket toward the nut merely effects the covering of the nut by the socket without any further indexing. The other indexing mechanism (not shown) is identical with that in FIG. 8. It is attached to rod 61 and coacts with the top of a gate 43 to provide for proper vertical alignment of the socket with the nut.

Figure 6:
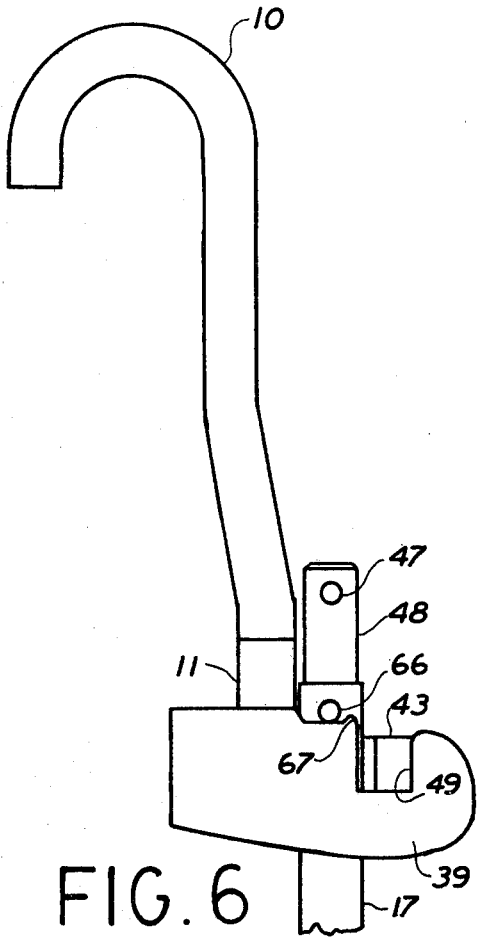
FIGS. 5 to 7 are respectively top, side and front (again based on FIG. 1) views of the left side of a portion of a mount according to the invention.
Figure 7:
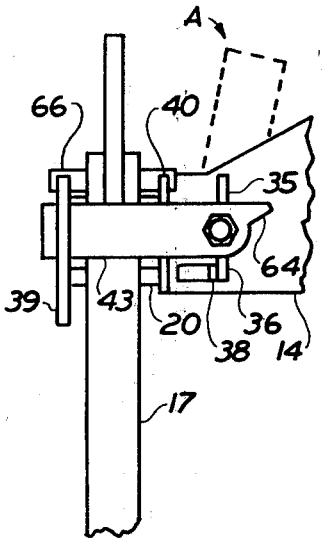

The clamp shown in FIGS. 5 to 7 is the clamp on the left of hanger 14 in FIG. 1. And, for this clamp on the left, the pivoting motion of the gate, from the closed position to the open position, is clockwise as viewed in FIG. 7. In order to achieve this clockwise pivoting, L-shaped arm 55 moves from the position shown in FIG. 5 approximately 180° of arc to rest beneath the gate. There, the arm slips with respect to the shaft until the gate becomes loose as socket 50 continues to turn nut 45. The nut 45 and bolt 44 are threaded such that clockwise rotation of the socket will loosen the nut. When the nut has been backed off sufficiently that the gate is loosened, the friction between the L-shaped arm and the shaft is then sufficient to rotate the gate into the open position indicated by arrow A. Face 49 is releasingly oriented, preferably perpendicularly, to the pivot axis of gate 43 so that pivoting of the gate is not resisted once nut 45 has been loosened. The gate is held in the open position by gravity.

For the clamp on the right side of hanger 14, the bolt and nut are threaded to loosen by counterclockwise rotation and an identical tool mounted on the portion of the crane or vehicle 58 broken away in FIG. 5 rotates the gate counterclockwise into an open position corresponding to a mirror image of that shown by arrow A. This provision of two identical tools on crane or vehicle 58 is preferred since both of the anodes on a hanger will usually be changed at the same time.

It is of advantage that the nut 45 be backed off less than completely on the bolt 44 so that the task of putting the nut back onto the bolt later can be avoided. This is accomplished visually by the workman operating the crane or vehicle or by means of a pneumatic control dependent on a chosen number of revolutions of the nut.

After the gate has been opened, the anode can be supported by pin 66 resting on top of hook 39, or its weight can be held by a crane or hoist whose cable is secured in hole 47. Anode bar 17 can then be removed together with the spent anode and a new anode is set in its place. Gate 43 is then swung down by arm 55 in the first tightening revolution of socket 50 until it engages hook 39 and nut 45 is subsequently tightened completely to secure the connection. During the subsequent tightening, arm 55 rests on the top of gate 43 and slips relative to shaft 52.

It will be apparent to those skilled in the art that any engagement of nut 45 with gate 43 is insufficient to pivot the gate into and out of confrontation with the backing formed by web plates 19 and 20 and that, instead, arm 55 does the pivoting. The pivoting force does not pass through the nut.

It will be understood that the above description of the present invention is susceptible to various modifications, changes and adaptations, and the same are intended to be comprehended within the meaning and range of equivalence of the appended claims.

What is claimed is:

1. In a clamp including means for providing a backing against which articles to be clamped can be placed, gate means mounted for pivoting about an axis into and out of confrontation with said backing means, said axis passing through said gate means, gate engaging means for preventing further pivoting of the gate means when the gate means is in confrontation with the backing means, and means for forcing the gate means toward the backing means at least when the gate means is in confrontation with said backing means, at least the portion of the gate means at said axis moving toward the backing means during operation of the forcing means in forcing the gate means toward the backing means, the means for forcing including a bolt secured at one end in the backing means and extending along said axis, with the gate means pivoting on the bolt, and a nut on the bolt end opposite to the end secured at the backing means, any engagement of the nut with the gate means being insufficient to pivot the gate means into and out of confrontation with said backing means, wherein the improvement comprises the fact that the direction of pivoting of the gate means away from the gate engaging means out of confrontation with said backing means is the same as the rotational direction of loosening of said nut and the direction of pivoting of the gate means toward the gate engaging means into confrontation with said backing means is the same as the rotational direction of tightening of said nut.

2. A tool capable of operating a clamp as claimed in claim 1, said tool comprising means for rotating said nut and means for pivoting said gate means without transferring the pivoting forces through the nut.

3. A tool as claimed in claim 2, comprising a motor, a shaft driven by the motor, a means on the shaft for turning the nut, and an arm means on the shaft for pivoting the gate when the gate is in a loose state and for slipping with respect to the shaft when the gate is in a secured state.

4. In an electrolysis cell having a superstructure (8), a clamp as claimed in claim 1, the clamp being adjustably mounted on the super structure for clamping as an article to be clamped, an anode bar (17).

5. A method of using a tool, which tool comprises a shaft means for transmitting a torque and an arm means clamped on the shaft means for following the shaft means or slipping relative thereto, depending on what forces are on the arm means, said method comprising engaging the shaft means with a nut means for tightening or releasing a clamp gate pivotably mounted on a bolt containing said nut means, turning the nut means with the shaft means to tighten or release the gate, engaging the gate with the arm means, and pivoting the gate with the arm means at least (1) at some time following transition of the gate from a tightened state to a released state or (2) at some time before transition of the gate from a released state to a tightened state, the pivoting being accomplished without transferring the pivoting forces through the nut.

6. In the operation of an electrolysis cell having a superstructure (8), a method as claimed in claim 5, the clamp gate being in an anode clamp adjustably mounted on the superstructure for clamping as an article to be clamped, an anode bar (17).

* * * * *

UNITED STATES PATENT AND TRADEMARK OFFICE

CERTIFICATE OF CORRECTION

PATENT NO. : 4,394,242

DATED : July 19, 1983

INVENTOR(S) : John F. Clark

It is certified that error appears in the above-identified patent and that said Letters Patent are hereby corrected as shown below:

On the title page:

Change the assignee from "Adnovum AG, Horn, Switzerland" to --Aluminum Company of America, Pittsburgh, Pennsylvania--.

Change the attorney from "Edwin E. Greigg" to --Daniel A. Sullivan Jr.--.

Signed and Sealed this

*Fourth* Day of *October 1983*

[SEAL]

*Attest:*

GERALD J. MOSSINGHOFF

*Attesting Officer*

*Commissioner of Patents and Trademarks*